US006882814B2

(12) United States Patent
Satoh et al.

(10) Patent No.: US 6,882,814 B2
(45) Date of Patent: Apr. 19, 2005

(54) CHARGING MEMBER, CHARGING APPARATUS AND IMAGE FORMING APPARATUS

(75) Inventors: Hiroshi Satoh, Toride (JP); Masataka Kodama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/413,379

(22) Filed: Apr. 15, 2003

(65) Prior Publication Data

US 2003/0219282 A1 Nov. 27, 2003

(30) Foreign Application Priority Data

Apr. 19, 2002 (JP) ..... 2002-117462

(51) Int. Cl.[7] ..... G03G 15/02
(52) U.S. Cl. ..... 399/176; 399/174
(58) Field of Search ..... 399/174, 175, 399/176

(56) References Cited

U.S. PATENT DOCUMENTS 6,023,597 A * 2/2000 Mayuzumi et al. ..... 399/176
6,128,456 A 10/2000 Chigono et al. ..... 399/176
6,343,199 B1 * 1/2002 Kodama ..... 399/176
6,393,243 B1 5/2002 Satoh et al. ..... 399/286
2002/0197082 A1 12/2002 Hosokawa et al. ..... 399/176

FOREIGN PATENT DOCUMENTS

EP 1 094 370 A2 4/2001
EP 1 251 409 A2 10/2002
JP 2000-81763 3/2000

* cited by examiner

*Primary Examiner*—Fred L. Braun
(74) *Attorney, Agent, or Firm*—Fitzpatrick, Cella, Harper & Scinto

(57) ABSTRACT

A charging member electrically charges a member to be charged in a state that said charging member forms a nip with the member to be charged and electroconductive particles are present at the nip. The charging member includes an elastic foam member provided at a surface of said charging member. The elastic foam member includes cell portions and cell wall portions defining the cell portions. The cell wall portions have a thickness proportion to the cell portions of not less than 2% and not more than 40%.

32 Claims, 10 Drawing Sheets

CHARGING MEMBER, CHARGING APPARATUS AND IMAGE FORMING APPARATUS

FIELD OF THE INVENTION AND RELATED ART

The present invention relates to a charging member for effecting charging by using electroconductive particles, a charging apparatus using the charging member, and an image forming apparatus using the charging member or the charging apparatus as charging means for charging a member to be charged.

FIG. 10 is a schematic sectional view of an example of a conventional ordinary image forming apparatus. The image forming apparatus in this example is an electrophotographic laser beam printer.

Referring to FIG. 10, the image forming apparatus includes a photosensitive drum 1 as an image bearing member, and the photosensitive drum 1 is rotatively driven in a clockwise direction of an arrow a at a predetermined peripheral speed.

The apparatus further includes an electroconductive elastic charge roller 20 as a charging member. The charge roller 20 is disposed in abutment with the photosensitive drum 1 at a predetermined pressing force and is rotated by the photosensitive drum 1. The charge roller 20 and the photosensitive drum 1 form an abutting portion (charging nip portion) S1 therebetween.

A predetermined charging bias voltage (e.g., a DC voltage of ca. 1–2 kV, or a DC voltage biased with an AC voltage) is applied from a power supply 13 to the charge roller 20, whereby the surface of the photosensitive drum 1 is uniformly contact-charged to a predetermined polarity and a predetermined potential.

The uniformly charged surface of the photosensitive drum 1 is subjected to scanning exposure with a laser beam L1 emitted from an exposure means (laser scanner) 8*a* via a reflection member 8*b* and an exposure window 6*a*, whereby an electrostatic latent image is formed on the photosensitive drum 1.

The electrostatic latent image is visualized as a toner image by a developing apparatus 3.

The developing apparatus 3 includes a non-magnetic developing sleeve 3*a*, which is a hollow cylindrical, as a developer carrying member, and a magnet roller 3*c* having multiple poles incorporated into the developing sleeve 3*a*. The developing sleeve 3*a* is disposed at an opening portion of the developing apparatus 3 while facing the photosensitive drum 1 and is rotatively driven in a counterclockwise direction of an arrow. The magnet roller 3*c* is fixed in a non-rotation state. A reference numeral 7 denotes a developer container disposed adjacent to the developing apparatus 3 and containing a magnetic toner as a developer t. The developer container 7 successively supplies the toner to the developing apparatus 3. The developer container 7 contains therein a developer stirring member 10. The toner contained in the developing apparatus 3 is attracted by a magnetic force of the magnet roller 3*c* to attach to and being carried on the surface of the developing sleeve 3*a*, thus being conveyed by rotation of the developing sleeve 3*a*. The developing apparatus 3 further includes a regulation blade 3*b* for regulating a toner layer thickness to a predetermined level while appropriately charging the toner. To the developing sleeve 3*a*, a predetermined developing bias voltage (e.g., a DC voltage biased with an AC voltage) is applied from a power supply 11, whereby the electrostatic latent image on the photosensitive drum 1 is visualized (developed) with the toner carried and conveyed by the developing sleeve 3*a* to a developing portion D as an opposing portion between the developing sleeve 3*a* and the photosensitive drum 1.

The toner image formed on the photosensitive drum 1 is successively transferred electrostatically onto a recording medium (transfer medium) P supplied from a paper feeding portion (not shown) to an abutting portion (transfer portion) T between the photosensitive drum 1 and a transfer roller 4 at a predetermined control timing. The transfer roller 4 is supplied with a predetermined transfer bias voltage from a power supply 12.

The transfer medium P after being subjected to transfer of the toner image at the transfer portion T is separated from the surface of the photosensitive drum 1 to be carried to a fixing means 9, where the toner image is fixed on the transfer medium P, which is then discharged from the image forming apparatus.

The surface of the photosensitive drum 1 after the transfer medium is separated is subjected to removal of a transfer residual toner remaining thereon by a cleaning blade 5*a* of a cleaning apparatus 5 to provide a cleaned surface, thus being repetitively subjected to image formation. A reference numeral 5*b* denotes a scoop sheet.

The printer in this example is of detachably mountable process cartridge-type. More specifically, four process equipments including the photosensitive drum 1, the charge roller 2, the developing apparatus 3 including the developer container 7, and the cleaning apparatus 5 are integrally supported in a compact unit to constitute a process cartridge 15 which is detachably and exchangeably mountable to the main body of the image forming apparatus.

In order to provide a smaller-sized process cartridge 15, an image forming apparatus employing a cleaner-less system wherein the cleaning apparatus 5 is removed from the process cartridge 15 and the developing apparatus 3 is designed to recover the transfer residual toner simultaneously with development has been proposed.

This cleaner-less system is not only effective in size reduction of the process cartridge but also discharges no waste toner, thus being preferable also from the viewpoint of environmental protection.

In this case, it has conventionally be well known that the cleaner-less system is established by a simultaneous development and recovery manner such that a so-called contact development using an elastic developing roller is adopted for effecting development while recovering the transfer residual toner with the elastic developing roller.

Further, if a direct injection charging mechanism is used for charge treatment of the image bearing member, an occurrence of ions is not caused, thus being advantageous in terms of no difficulty due to discharge products. For example, U.S. Pat. No. 6,128,456 discloses a direct charging mechanism such that electroconductive particles are contained in a developer and are supplied from a developing device to an image bearing member together with a toner, followed by attachment of the electroconductive particles to a charging member. In addition, the direct charging mechanism is used in combination with the cleaner-less system, thus being effective in both of environmental protection and size reduction of the process cartridge.

The electroconductive particles used in U.S. Pat. No. 6,128,456 are particles for the purpose of assistance of charging in the direct injection charging system, and are present at least at an abutting portion (charging nip portion) between a contact charging member and a member to be charged, thus realizing stable injection charging.

More specifically, the contact charging of the member to be charged is performed in a state that the electroconductive particles are present in the charging nip portion between the member to be charged and the contact charging member. By the presence of the electroconductive particles in the charging nip portion, it becomes possible not only to readily placing the member to be charged in a contact moving state against the contact charging member by a lubricating effect of the electroconductive particles but also to cause the contact charging member to intimately contact the member to be charged via the electroconductive particles at a high frequency. As a result, in the charging nip portion, the moving surface of the member to be charged is uniformly rubbed with the electroconductive particles, so that it is possible to retain an intimate contact state and a contact resistance between the contact charging member and the member to b charged. Consequently, it becomes possible to effect the direct injection charging excellent in uniformity and charging performance, so that the direct injection charging assumes a dominant position in the contact charging of the member to be charged by the above-mentioned contact charging member.

As described above, the elastic layer of the charging member may preferably have an intimate contact performance. In this respect, an open-cell sponge roller is considered to be suitable for the charging member.

However, in the case where the open-cell sponge roller is used in the cleaner-less system, an amount of accumulation of fibrous paper powder becomes lager with an increasing number of printing sheets, so that a lump of the transfer residual toner containing the paper powder as a core is caused to occur, thus leading to an occurrence of charging failure.

On the other hand, if a complete closed-cell sponge roller is used as the charge roller, the surface of the sponge roller has a nonuniform foaming part, thus failing to provide an intimate contact state with the member to be charged to cause charging failure.

SUMMARY OF THE INVENTION

An object of the present invention is to provide a charging member for effecting a uniform charging by using electroconductive particles, and charging apparatus and image forming apparatus including the charging member.

Another object of the present invention is to provide a charging member capable of allowing intimate contact of electroconductive particles with a member to be charged, and charging apparatus and image forming apparatus including the charging member.

A further object of the present invention is to provide a charging member capable of uniformly coating electroconductive particles on a foam member, and charging apparatus and image forming apparatus including the charging member.

A still further object of the present invention is to provide a charging member suitable for injection charging system, and charging apparatus and image forming apparatus including the charging member.

According to the present invention, there is provided a charging member for charging a member to be charged in a state that the charging member forms a nip with the member to be charged and electroconductive particles are present at the nip, the charging member comprising:

an elastic foam member provided at a surface of the charging member, the elastic foam member including cell portions and cell wall portion defining the cell portions, wherein the cell wall portions have a thickness proportion to the cell portions of not less than 2% and not more than 40%.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
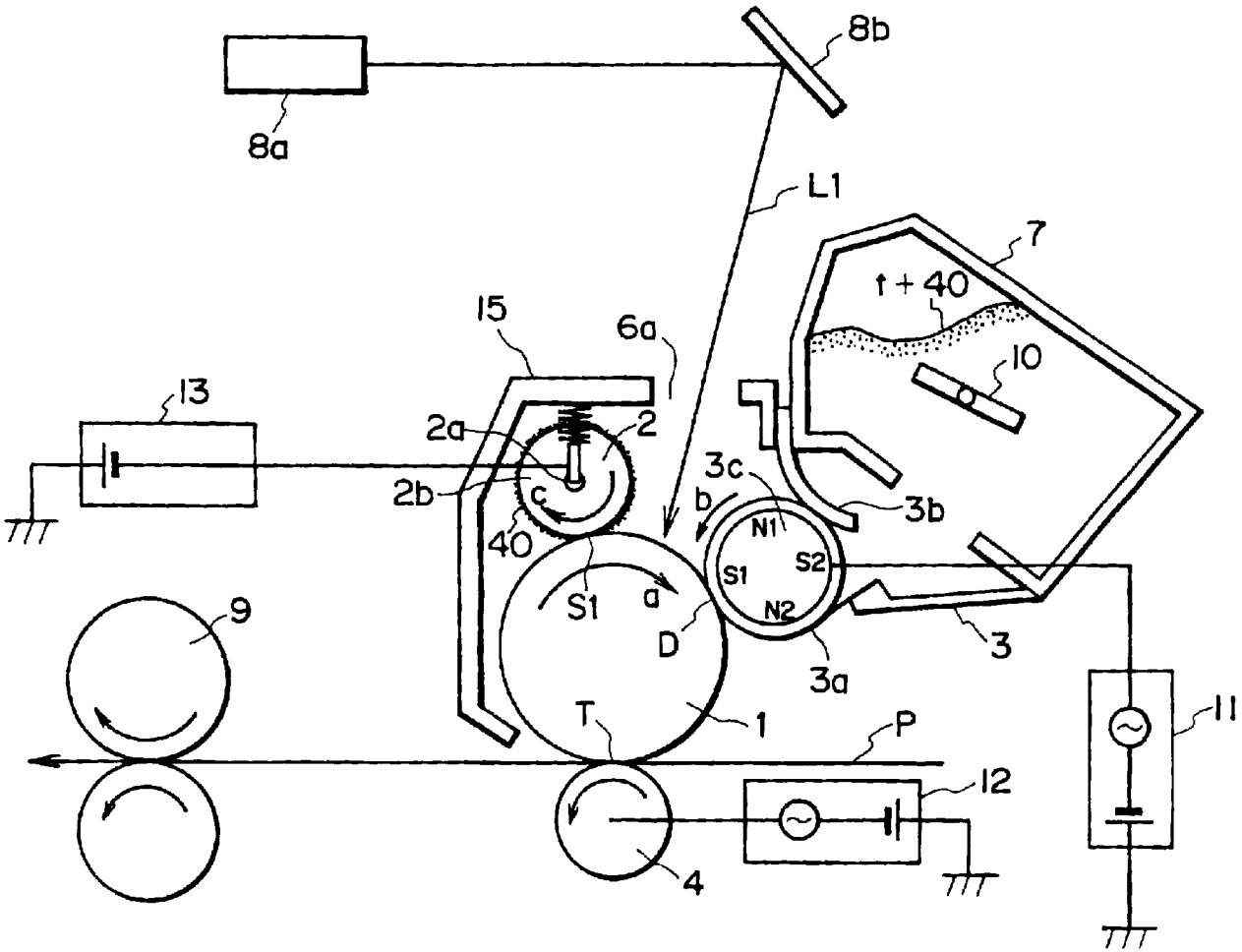
FIG. 1 is a schematic sectional view of an image forming apparatus according to the present invention.

FIG. 1 schematic illustrates an embodiment of the image forming apparatus according to the present invention, which includes a contact injection charging means using electroconductive particles as a charging means for charging an image bearing member and is an electrophotographic laser beam printer of a cleaner-less system.

Figure 10:
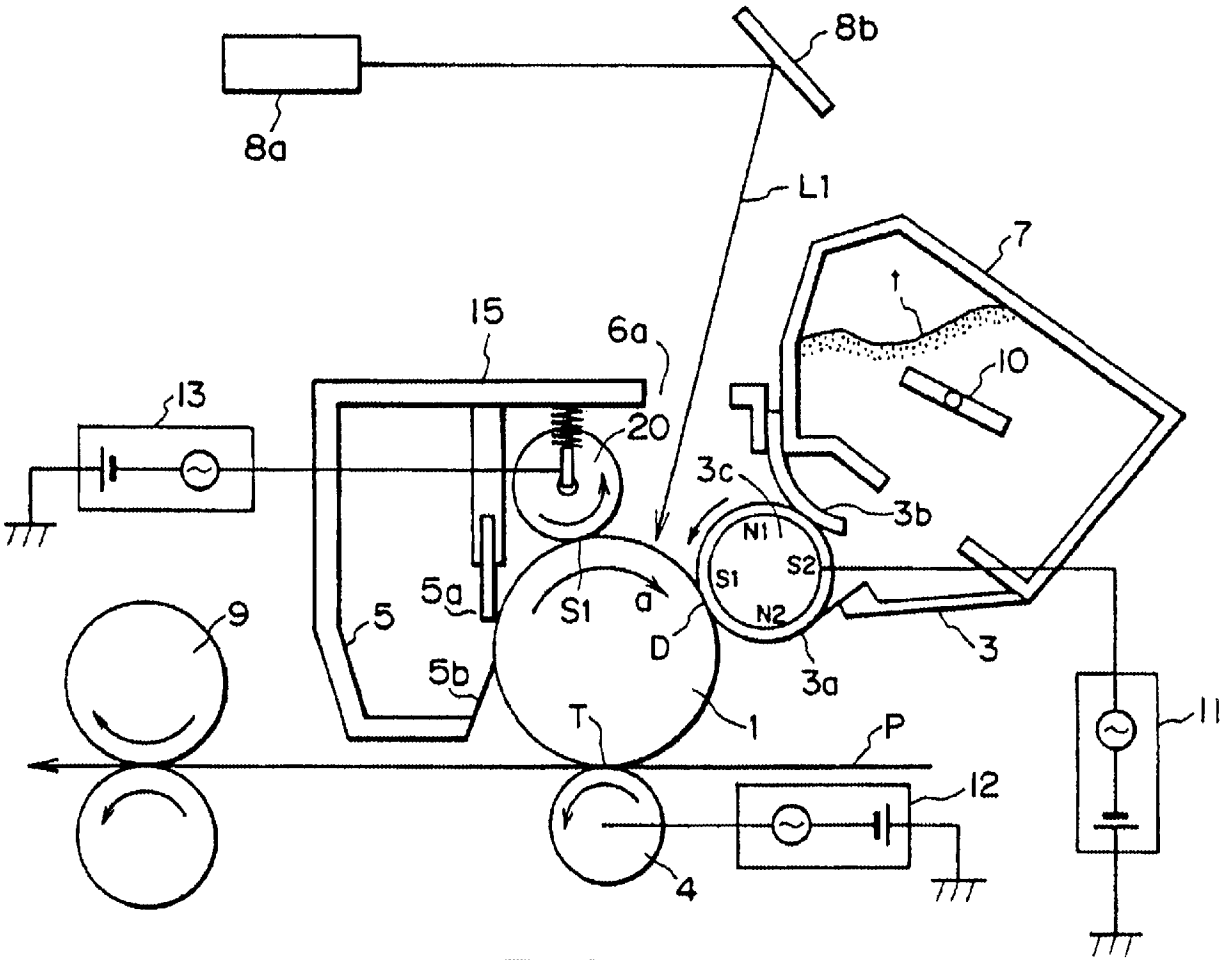
FIG. 10 PRIOR ART
FIG. 10 is a schematic sectional view of a conventional image forming apparatus.

In FIG. 1, members and means identical to those shown in FIG. 10 are represented by the same reference numerals as in FIG. 10, and repetitive explanation thereof will be omitted.

(1) General Explanation of Image Forming Apparatus

The electrophotographic laser beam printer (image forming apparatus) in this embodiment is different from that shown in FIG. 10 in the following points (a) to (e).

(a) The cleaning apparatus is removed (cleaner-less system).

(b) The contact charging member is a sponge roller 2 surface-coated with electroconductive particles 40 in advance.

(c) The sponge roller 2 is designed to cause counter-directional movement in a rotation direction c relative to the rotation direction a of the photosensitive drum 1 with a predetermined difference in peripheral speed at the abutting portion (nip portion) S1 between the sponge roller 2 and the photosensitive drum 1.

(d) Only a DC voltage is applied to the sponge roller 2 as the charging bias voltage.

(e) Electroconductive particles 40 are preliminarily mixed with the developer (toner) t contained in the developing container 7 of the developing apparatus 3 in a predetermined proportion.

1) Charging

With respect to a new process cartridge 15 before the use of users, the sponge roller 2 as the charging member is coated with electroconductive particles 40. Accordingly, even in the process cartridge at an initial stage, the electroconductive particles 40 are present at the abutting portion S1 of the photosensitive drum (image bearing member) 1 as the member to be charged with the sponge roller 2, so that the surface of the photosensitive drum 1 can be uniformly charged to have a dark-part potential (Vd) of about −600 V by causing the sponge roller 2 containing the core metal 2*a* as an electrode supplied with a predetermined charging bias voltage (a DC Voltage of −600 V) from the power supply 13 to contact the photosensitive drum 1.

On the other hand, in the conventional apparatus as shown in FIG. 10, the charge roller 20 as the contact charging member has ordinarily been supplied with a DC voltage biased with an AC voltage (DC/AC superposed voltage) to stably charge the photosensitive drum surface, thus preventing image defects such as sandy image (a phenomenon that toner particles are jumped and attached to a white background) due to charging failure. However, as already described hereinabove, it is impossible in principle to inevitably cause an occurrence of discharge products in such a discharge-based charging mechanism.

In this embodiment, as described above, only the DC voltage is used, so that it is possible to charge the photosensitive drum surface without producing the discharge products.

The sponge roller 2 as the contact charging member will be described in detail in section (2) appearing hereinafter. The sponge roller 2 is prepared by forming a medium-resistivity layer 2*b* a flexible foam member on a core metal 2*a*.

The rotation direction c of the sponge roller 2 is a counter direction to the rotation direction a at the abutting portion S1 located between the sponge roller 2 and the photosensitive drum 1. By rotating the sponge roller 2 at a speed of 150% in terms of a peripheral speed difference relative to the rotation speed of the photosensitive drum 1, a large amount of electroconductive particles 40 present on the surface of photosensitive drum 1 are scraped off the photosensitive drum surface. As a result, it is possible to provide the sponge roller surface with the electroconductive particles 40 supplied from the developing sleeve 3*a* (described later) to the surface of the photosensitive drum 1, thus realizing direct injection charging through the presence of the electroconductive particles 40 between the sponge roller 2 and the photosensitive drum 1.

The charging performance of the direct injection charging depends on a ratio between the peripheral speed of the member to be charged and the peripheral speed of the charging member, so that the number of revolutions of the charging member in the case of forward direction rotation mode is increased in order to attain the peripheral speed ratio identical to that in the case of opposite direction rotation mode when compared with the case of opposition direction rotation mode. Herein, the peripheral speed ratio is represented by the following equation:

Peripheral speed ratio (%)=[(charging member peripheral speed−peripheral speed of member to be charged)/(peripheral speed of member to be charged]×100

The charging member peripheral surface is a positive value when the charging member surface moves in the same direction as the surface of the member to be charged at the nip portion.

The peripheral speed ratio may preferably be not less than 120%.

2) Exposure

As described above, the surface of the photosensitive drum 1 is irradiated with the laser beam L1 emitted from the exposure means 8*a* via the reflection member 8*b* and the exposure window 6*a* to form an electrostatic latent image on the surface of the photosensitive drum 1. The surface potential of the photosensitive drum 1 in the case of uniformly irradiating the photosensitive drum surface with the laser beam L1 is set to a light-part potential (VL=−150 V) in this embodiment.

3) Development

The developing apparatus 3 is constituted by a developing sleeve 3*a* as a developer carrying member (toner carrying member) disposed 300 μm distant from the photosensitive drum 1, a blade 3*b*, a magnet roller 3*c* enclosed within the developing sleeve 3*a*, a power supply 11 for feeding power to the developing sleeve 3*a*, etc. The developing sleeve 3*a* comprises a crude aluminum pipe coated with a coating material which comprises a binder (acrylic resin), and a pigment and a roughening agent (spherical carbon particles: particle size=10 μm, the density=2.0 g/cm$^3$), for providing an appropriate roughness to the developing sleeve surface, disposed in the binder.

The spherical carbon particles used as the roughening agent may be prepared in such a manner that a bulk mesophase pitch is coated by mechanochemical method on the surface of spherical particles of a resin, such as phenolic resin, naphthalene resin, furan resin, xylene resin, vinylbenzene polymer, styrene-divinylbenzene polymer or polyacrylonitrile, and the coated particles are heat-treated in an oxidation atmosphere and cured in an inert atmosphere or in a vacuum to effect carbonization and/or graphitization thus obtaining electroconductive spherical carbon particles. The thus obtained spherical carbon particles may preferably be prepared through graphitization since the coating portion of the resultant spherical carbon particles is further crystallized to improve electroconductivity. In this embodiment, a measured surface roughness (Ra) of the developing sleeve is 1.4 μm.

Herein, in this embodiment, a surface roughness Rz of the toner carrying member corresponds to a center-line average roughness measured by a surface roughness meter ("Surf coder SE-30", mfd. by K. K. Kosaka Kenkyusho) on the basis of JIS surface roughness (JIS B0601).

More specifically, with respect to 12 points including 3 points of the toner carrying member in an axis direction by 4 points thereof in a circumferential direction, a portion having a measuring span of 2.5 mm in the axis direction is sampled therefrom and subjected to measurement to determine the surface roughness Rz through calculation from height values in a vertical sealing direction of the sampled portion.

By the rotational drive of the developing sleeve 3*a*, the toner t containing electroconductive particles 40 within the developing container 7 is carried to the photosensitive drum 1. The rotation direction of the developing sleeve 3*a* is a forward direction b relative to the rotation direction a of the photosensitive drum 1 and the developing sleeve 3*a* is rotatively driven at a peripheral speed ratio of 120% relative to the peripheral speed of the photosensitive drum 1.

The regulation blade 3*b* for regulating and charging the toner on the developing sleeve 3*a* is formed of a 1.1 mm-thick urethane rubber plate and abuts against the developing sleeve 3*a* at a linear pressure of about 49 N/m, whereby styrene resin as a main component of the toner is rubbed, thus being negatively charged.

In this embodiment, a superposed voltage comprising an AC voltage of 1.2 kV and a DC voltage of −450 V is applied from the power supply 11 to the developing sleeve 3*a* of the developing apparatus 3*a* to visualized the electrostatic latent image on the photosensitive drum 1 with the negatively charged toner t carried to the photosensitive drum surface.

In this embodiment, to 100 wt. parts of styrene resin as the toner main component, 2 wt. parts of silica for promoting toner charging and 2 wt. parts of electroconductive zinc oxide particles (volume resistivity: $10^6$ ohm.cm, average particle size including secondary aggregate: 3 $\mu$m) as the electroconductive particles 40 are externally added.

The average particle size and particle size distribution of the electroconductive particles (electroconductive fine powder) used in the present invention is measured in a measuring range of 0.04–2000 $\mu$m by using a laser diffraction-type particle size distribution measuring apparatus (Model LS-230, md. by Coulter, Co.) equipped with a liquid module.

More specifically, a trace amount of a surfactant is added in 10 cc of pure water, and 10 mg of a sample electroconductive fine powder (electroconductive particles) is added thereto, followed by dispersion for 10 minutes by an ultrasonic dispersing device (ultrasonic homogenizer). Thereafter, measurement is performed one time for 90 sec. Based on the measured results, a volume-average particle size is calculated.

Further, the measurement of the volume resistivity of the electroconductive fine powder is performed by the tablet method in combination of normalization.

More specifically, about 0.5 g of powdery sample is placed in a cylindrical vessel having an area of base of 2.26 $cm^2$ and is supplied with a voltage of 100 V between upper and lower electrodes under application of a pressure of 15 kg to measure a resistivity value followed by normalization to determine a volume resistivity.

Figure 2:
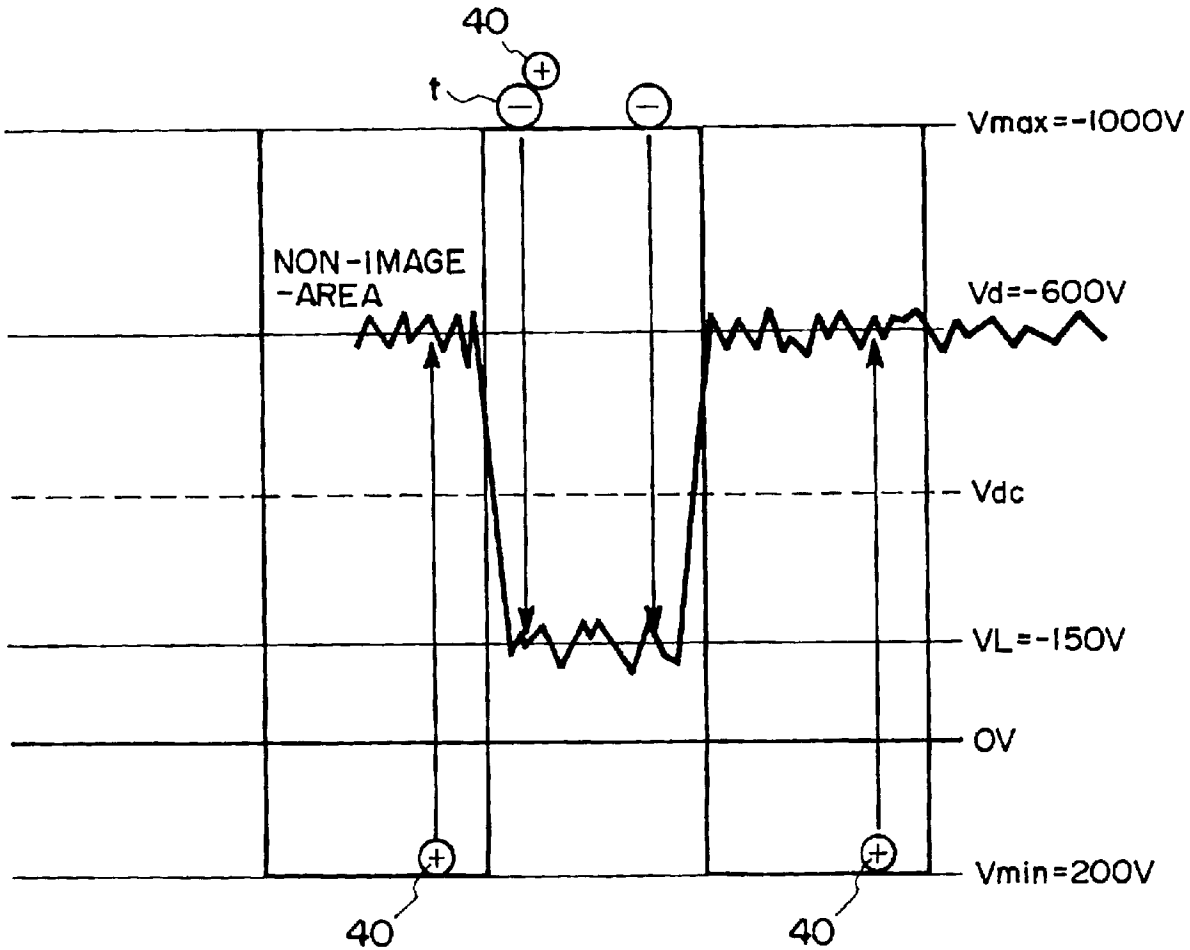
FIGS. 2 and 3 are respectively a schematic view showing a state of electrical jumping of a toner and an electroconductive particle toward an image portion and a non-image portion on a photosensitive drum surface at a developing portion.
Figure 3:
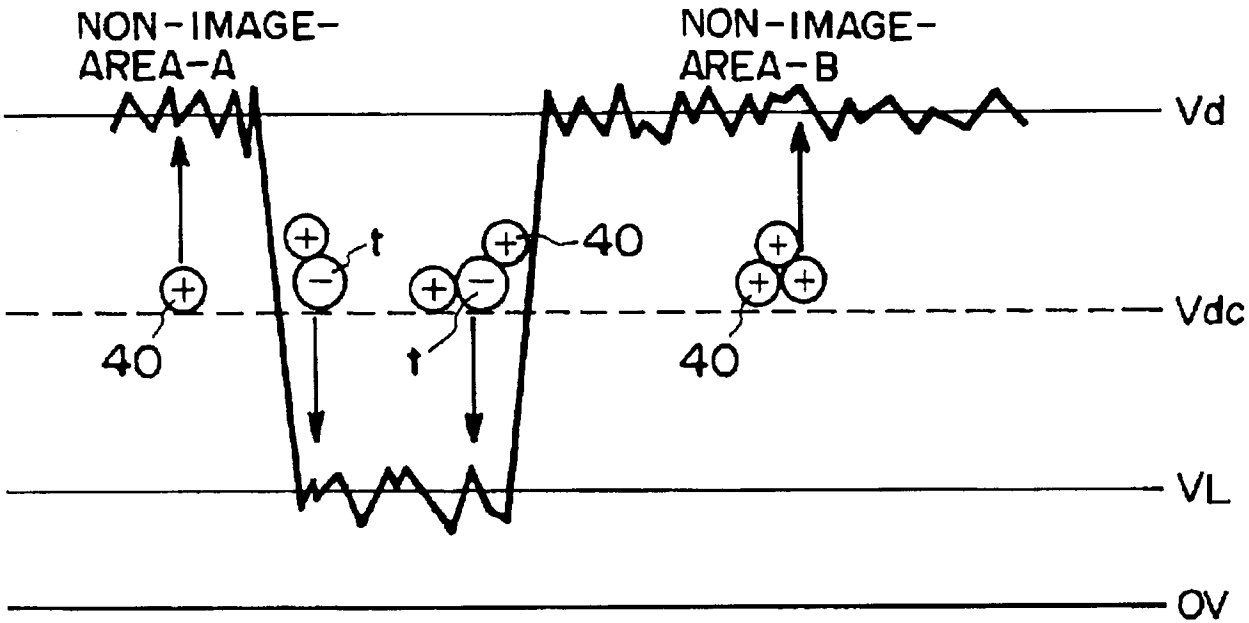

The electroconductive particles 40 as the external additive have a low resistivity and tends to exhibit a weak positive chargeability, so that, as shown in FIGS. 2 and 3, the external additive alone is jumps from the developing sleeve 3*a* to a non-image area of the photosensitive drum 1 under application of a contract voltage of 800 V (i.e., $|V_{min}-V_d|=|200\ V-(-600\ V)|$. Further, a part of the external additive attaches to the toner, so that such an external additive jumps from the developing sleeve 3*a* to an image area of the photosensitive drum 1 under application of a constant voltage of 850 V (i.e., $|V_L-V_{max}|=|-150\ V-(-1000\ V)|$.

These electroconductive particles 40 jumped to the photosensitive drum 1 exhibit sufficiently lower resistivity than the toner particles and the electroconductive zinc oxide particles (as the electroconductive particles 40) exhibit a positive chargeability as described above, so that most of the electroconductive particles 40 are still remaining on the photosensitive drum 1 without being transferred onto a transfer medium by application of a positive-polarity transfer bias. Accordingly, it is possible to accomplish the direct injection charging by supplying a sufficient amount of the electroconductive particles 40 to the sponge roller 2.

4) Transfer

Thereafter, a voltage of a polarity opposite to that of the toner image is applied to the transfer roller 4, whereby the toner image formed on the photosensitive drum 1 is transferred onto the transfer medium P as the recording medium.

5) Fixation

The transfer medium P onto which the toner image is transferred at the transfer portion T is separated from the surface of the photosensitive drum 1 and is carried to a fixing means 9. The toner image is fixed on the transfer medium P by the fixing means to be then discharged outside the image forming apparatus.

6) Cleaning Simultaneous with Developing

The printer in this embodiment is of the cleaner-less system using no cleaner, so that the transfer residual toner remaining on the rotating surface of the photosensitive drum 1 after the toner image carried on the photosensitive drum 1 is transferred onto the transfer medium P is not removed by the cleaner but is carried by the rotation of the photosensitive drum 1 to a developing region via the sponge roller 2. At the developing region, the transfer residual toner is recovered by the developing sleeve 3*a* according to developing simultaneous with cleaning (toner recycling process).

(2) Sponge Roller 2

Next, the sponge roller 2 as the charging member for contact charging using the electroconductive particles 40 in this embodiment will be described in detail.

The sponge roller 2 is prepared by forming an elastic layer 2*a* as an electrode to be supplied with a voltage. The elastic layer 2*b* comprises a rubber (such as EPDM), electroconductive particles (such as carbon black), a vulcanizing agent, a foaming agent, etc., and is formed in a roller shape on the core metal 2*a* through extrusion and heating, followed by surface polishing to prepare a sponge roller 2.

The sponge roller 2 has an uneven surface which is given by the polishing process and is constituted by cell portions of sponge rubber and cell wall portion for partitioning the cell portions. The surface state of the sponge roller 2 comprising the cell portions and the cell wall may be modified into various states by appropriately selecting the vulcanizing agent, the foaming agent and/or heating means. Further, in order to provide an uneven surface portion with a network structure, it is possible to use a method wherein a low-molecular substance mixed in a polymeric substance is eluted by an eluent or a method wherein a non-foam member is surface-treated by polishing, etching, etc.

In the case where an elastic layer having a network structure is formed by foaming and oxidizing a rubber, it is possible to form a network structure having a predetermined cell edge length by appropriately selecting the kinds of the foaming agent and a vulcanizing accelerator, foaming conditions, vulcanization conditions, etc.

For example, at a stage such that a curing reaction of the rubber proceeds to some extent, i.e., in a state such that the rubber has a high viscosity the foaming agent is thermally decomposed to cause a large amount of generation of gas to result in small cells. Further, by effecting the foaming treatment with steam heating, it is possible to reduce the size of foams under application of water vapor pressure to form a lot of small cells.

In the case of forming a network structure by foaming EPDM rubber (ethylene-propylene rubber), it is particularly appropriate that azodicabonamide is used as the foaming agent, a thiazole-based compound and a dithiocarbamate-based compound are used as the vulcanizing accelerator, and sulfur is used as the vulcanizing agent. Further, at that time, it is appropriate that the amount of the thiozole-based compound and the dithiocarbamate-based compound is 3–5 wt. parts per 100 wt. parts of EPDM rubber.

The foam member may preferably have a specific gravity in a range of 0.2–0.6 in order to provide a cell edge length of 15–60 $mm/mm^2$.

Further, by increasing a foaming ratio, the hardness of the roller is decreased, so that it is possible to ensure a nip width required to charge the member to be charged (photosensitive drum 1) with the sponge roller 2, thus resulting in an increased charge efficiency. However, when the foaming ratio is excessively increased, a resultant strength of the sponge roller becomes insufficient, thus being liable to cause deformation to lower a charging performance. Accordingly, the foaming ratio may preferably be not less than 1.5 and not more than 5.

The foaming ratio is calculated according to the following equation using specific gravities ($g/cm^3$) before and after foaming:

Foaming ratio=(specific gravity before foaming)/(specific gravity after foaming)

It is important for the sponge roller 2 to function as the electrode, so that the sponge roller 2 is required to not only be provided with an elasticity allowing a sufficient contact state but also have a sufficiently low resistance to charge the moving member to be charged. On the other hand, however, it is necessary to prevent an occurrence of leakage of voltage in the case where a defective portion such as pinhole is present in the member to be charged. For this reason, when the electrophotographic photosensitive member is used as the member to be charged, it is desirable that the sponge roller 2 has a resistance of $10^4$–$10^7$ ohm in order to attain sufficient charging performance and leakage resistance.

The sponge roller 2 may preferably have an ASKER-C hardness of 10–30 degrees since if the hardness is too low, the shape of the sponge roller 2 is not stabilized to lower the contact performance and if the hardness is too large, not only the charging nip S1 cannot be ensured but also a microscopic contact state of the sponge roller 2 with the photosensitive drum surface becomes worse.

In this embodiment, the ASKER-C hardness is used for evaluating a softness of the entire sponge roller and is measured by using an ASKER-C hardness meter (mfd. by Kobunshi Keiki K. K.) which is a hardness meter for measuring a rubber hardness. It becomes possible to provide the photosensitive drum with a sufficient nip by providing a measured ASKER-C hardness of 10–30 degrees.

As the elastic layer 2*b* of the sponge roller 2, it is possible to use a rubber layer prepared by dispersing an electroconductive substance, such as carbon black or metal oxide, for resistance control, in the rubber component such as EPDM (ethylene-propylene rubber), urethane rubber, NBR (nitrile-butadiene rubber), silicone rubber, IR (butyl rubber), etc. Further, it is also possible to effect resistance control by using an ion-conductive material without particularly dispersing the electroconductive substance. Further, the resistance control can also be effected by mixing a metal oxide with the ion-conductive material.

In order to stabilize the abutment of the sponge roller 2 against the photosensitive drum 1, the sponge roller 2 is required to have a softness at its surface. This softness is almost given by the minute cell structure prepared by the above-mentioned production process but is also largely affected by the rubber material.

Accordingly, in this embodiment, EPDM is employed as the rubber material, whereby the resultant sponge roller 2 has a softness suitable for the rubber material. At the same time, it is possible to provide the sponge roller surface with minute cells through the above-mentioned production process. As a result, it becomes possible to obtain not only a sufficiently small cell wall portion thickness but also a characteristic like a minute brush having an elasticity.

When the rubber hardness of the surface of the sponge roller 2 used in this embodiment is measured by a micro hardness meter ("MD-1", mfd. by Kobunshi Keiki K. K.), the measured rubber hardness was about 14 degrees. This value is an average of arbitrary 10 points in a longitudinal direction and a circumferential direction of the sponge roller 2. The measured values show a small variation within 14±2 degrees. This is attributable to the use of the above cell structure and rubber material. As a result, it is possible to effect the abutment of the sponge roller 2 on the photosensitive drum 1 at a minute level. As described above, the hardness of the charging member surface is made soft in terms of the micro hardness of 12–16 degrees, so that it becomes possible to uniformize the abutting state of the charging member with the member to be charged. As a result, it is possible to further improve the charging performance to the member to be charged.

The micro hardness meter is suitable for measurement of a small-sized sample or a thin sample, thus being adopted in this embodiment as means for evaluating a softness of the surface layer of the sponge roller 2.

The sponge roller 2 prepared through the above-mentioned process is surface-polished to have a final surface shape.

The sponge roller 2 used in this embodiment is very soft as described above and has a minute cell structure. For this reason, with respect to the surface polishing as the final step, such a rough polishing that the polished surface is observed should not be effected.

Hereinbelow, the cell wall of the elastic foam member used in the sponge roller 2 as a characteristic feature of the present invention will be described.

Figure 4:
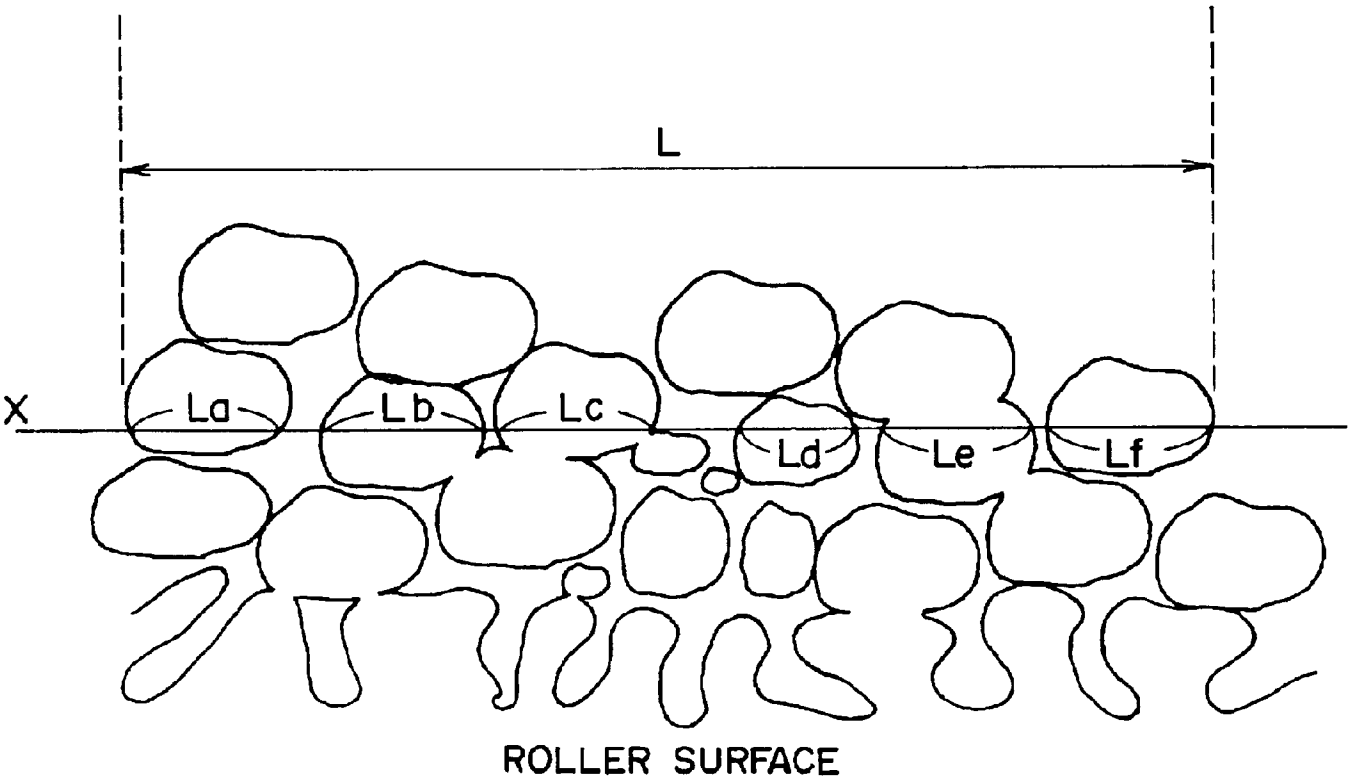
FIG. 4 is a schematic illustration of a photograph taken by a SEM or a vid micro camera on a surface section of a sponge roller as a charging member cut by a cutter or a knife linearly in a longitudinal direction of the sponge roller.

For variation thereof, first, the surface of the sponge roller 2 is linearly cut in its longitudinal direction by means of a cutter or a knife, followed by photo-shooting with a SEM or a micro video camera. FIG. 4 is a schematic illustration of the resultant photograph. Referring to FIG. 4, a straight line X is drawn in parallel with a generating line of the sponge roller 2 at a depth corresponding to two or three cells rom the roller surface. On the straight line X, 20–30 cells are taken and subjected to calculation of a total length LA of the cell portion (LA=La+Lb+Lc+. . . ). At this time, when a measurement generating line is represented by L, a total thickness LB of the cell wall portions is represented by the equation: BL=L−LA. Accordingly, a ratio (thickness proportion) Rs of the total thickness of the cell wall portions to the total diameter of the cell portions is represented by the equation: Rs=LB/LA.

In this embodiment, the elastic foam member shows an Rs (the thickness proportion (ratio) of the total cell wall portion thickness to the total cell portion diameter) of about 30%, so that it is possible to provide a sufficiently thin cell wall portions against the cell portion diameter.

When the resultant sponge roller 2 is caused to abut against the photosensitive drum 1, the cell wall is sufficiently thin, thus being pressed by the photosensitive drum 1 to further uniformize the abutment state of the sponge roller 2 against the photosensitive drum 1.

If the ratio Rs of the elastic foam member of the charging member (sponge roller 2) is less than 2%, the cell wall becomes thin and it undesirably becomes difficult to keep the cell shape.

If the ratio Rs exceeds 40%, it undesirably becomes impossible to intimately coat the electroconductive particles on the surface of the charging member constituted by the elastic foam member.

Accordingly, the ratio Rs may preferably be not less than 2% and not more than 40%.

In order to realize uniform and stable injection charging to the member to be charged, the cell wall portions directly abutting the member to be charged is required to be made thin, i.e., to increase a contact area per unit area for improving the charging performance. Further, by uniformly coating the inner surface of the cell portions exhibiting a close contact performance with the electroconductive particles, it is possible to uniformly charge the member to be charged.

A method of experimentally observing such a state will be explained with reference to FIG. 5.

Figure 5:
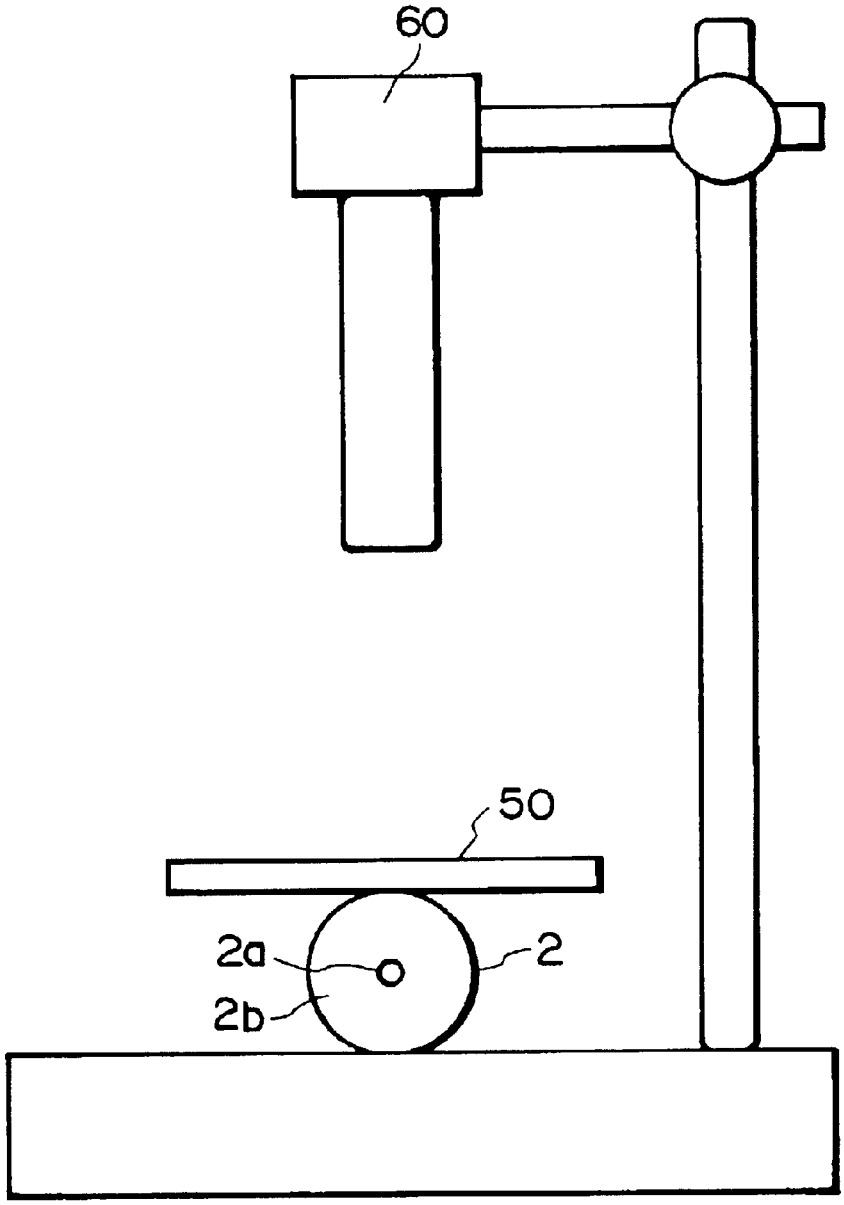
FIG. 5 is a schematic view for explaining a method of experimentally observing a state of a cell wall which is pressed against a photosensitive drum when a sponge roller is caused to abut against the photosensitive drum.

Referring to FIG. 5, a reference numeral 60 denotes a video microscope ("KEYENCE VH-6300") equipped with a zoom lens ("VH-Z150") (magnification: 200). A glass plate 50 is caused to abut on the sponge roller 2 used in this embodiment under a total load of about 800 g.

Figure 6:
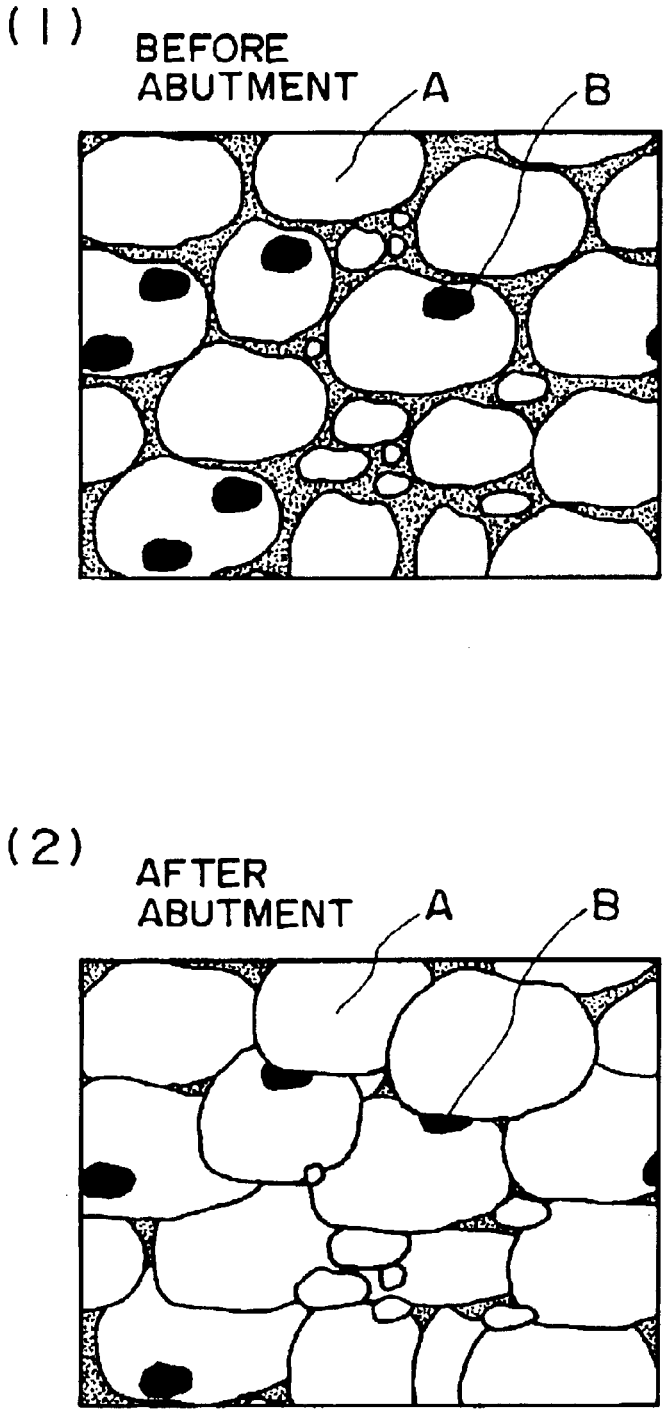
FIG. 6(1) is a schematic illustration of a photograph of a sponge roller surface before abutment against a photosensitive drum, and FIG. 6(2) is a schematic illustration of a photograph of the sponge roller surface after the abutment.

FIG. 6(1) is a schematic illustration of a photograph at the roller surface before the abutment and FIG. 6(2) is a schematic illustration of a photograph at the roller surface after the abutment.

Referring to FIG. 6(1), as a result of the polishing of the roller surface, it is confirmed that the thin cell wall is broken. However, even through this observation, it is possible to confirm almost cell shape and A shown in the figure represents one cell portion. Further, the cell structure in this embodiment is not a complete closed-cell structure but exhibits a communicating characteristic such that a cell (portion) is connected to another cell (portion). For this reason, some points (gaps) B connecting an upper cell to a lower cell are confirmed as a dark (black) shadow.

Such a gap may preferably have an areal ratio, to the surface area of the cell wall portions at the surface of the sponge roller 2, of not less than 5% and not more than 50%. In FIG. 6(1), 20–30 cells are picked in the order of size, starting from the large stone (since the possibility that an apparently large cell is broken at the center thereof is increased), and the projected area of A of each cell and the area B of the gap (passage connecting a cell portion to an adjacent cell portion) are measured to obtain an average of the ratios therebetween.

Gap ratio of each cell=(area *B* of gap/projected area *A* of each cell)×100

The values of the gap ratios of the measured cells are averaged (average gap ratio).

However, as described above, the thin cell wall portions are broken as the result of polishing, so that it is difficult to accurately grasp the cell shape. Further, the electric foam member in this embodiment has sufficiently thin cell wall portions, so that it is also possible to determine a gap ratio of each cell as an areal ratio of the gap per unit area by neglecting the cell wall portion thickness in the surface photograph (illustration).

Gap ratio of each cell=(area *B* of gap/area *S* of arbitrary region at roller surface)×100

The arbitrary region at the roller surface contains at least 100 cells and two or more of such arbitrary regions are subjected to measurement to obtain its average value.

In this embodiment, the resultant average gap ratio per unit area calculated in the above manner was ca. 20%. Accordingly, it is possible to prevent an accumulation of paper dust while keeping an appropriate particle-holding ability.

In this embodiment, the surface photograph is taken by using the video microscope but it is possible to use an SEM if it is difficult to observe the cell shape due to the surface polishing.

Referring to FIG. 6(2), when the glass plate 50 is caused to about on the sponge roller 2, the gap is filled up by the cell wall portions under the pressure of the glass plate 50. Accordingly, it is confirmed that the cell wall portions intimately contact the glass plate surface. Even in this case, the average gap ratio per nit area was ca. 10% as a result of calculation in the above-described manner.

Figure 7:
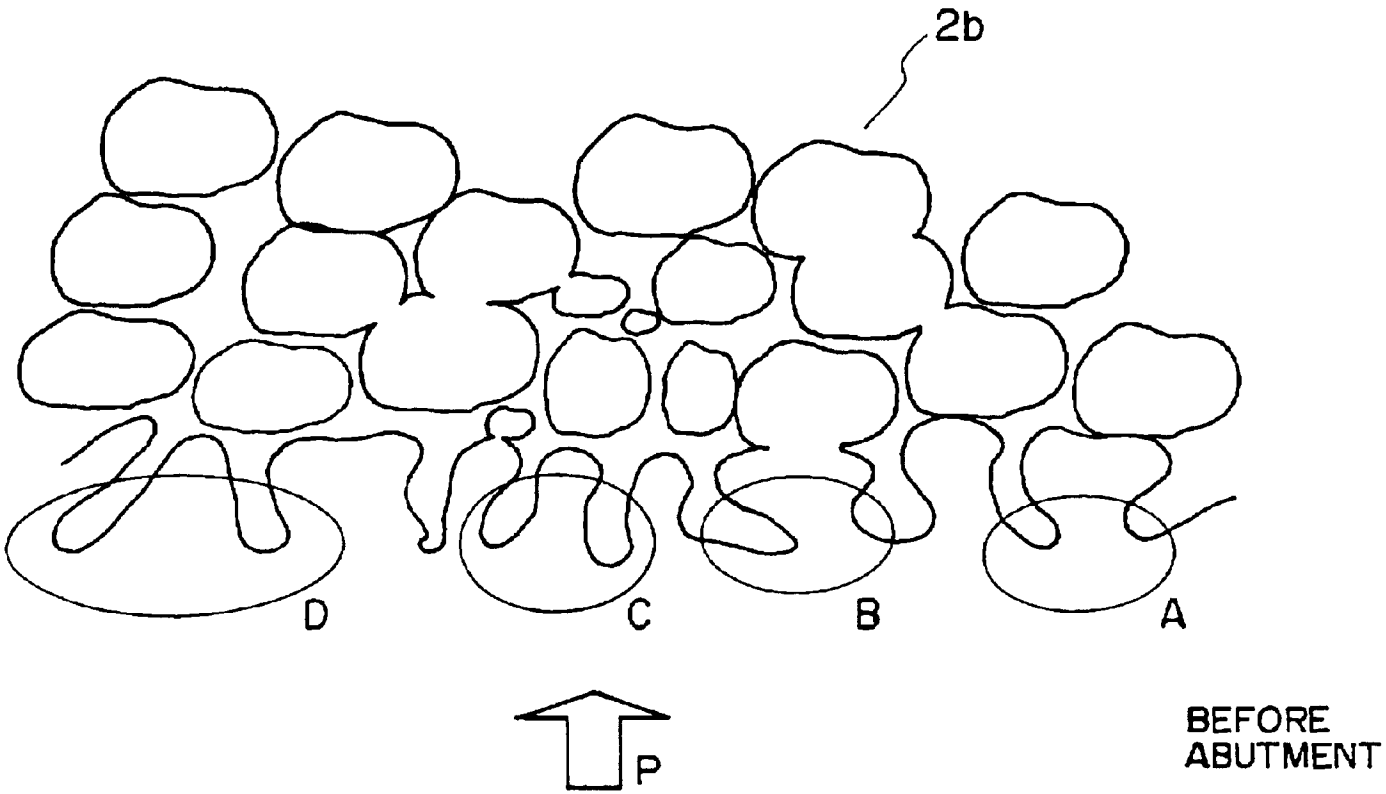
FIG. 7 is a schematic sectional view of the sponge roller surface in a state that a glass plate does not abut on the sponge roller surface.

FIG. 7 is a schematic illustration of a cross-section of the sponge roller 2 in such a state that the glass plate 50 does not abut on the sponge roller surface.

Referring to FIG. 7, from an observation direction P, no gap is observed since an outer cell and an inner cell are not connected to each other at an opening portion A of the cell portions. On the other hand, at an opening portion B, the outer cell communicates with the inner cell to observe the gap. Further, each at opening portions C and D, although the outer cell and the inner cell ate not connected to each other, it is observed that the cell wall portions form an opening toward the abutting surface (the observation direction P).

Figure 8:
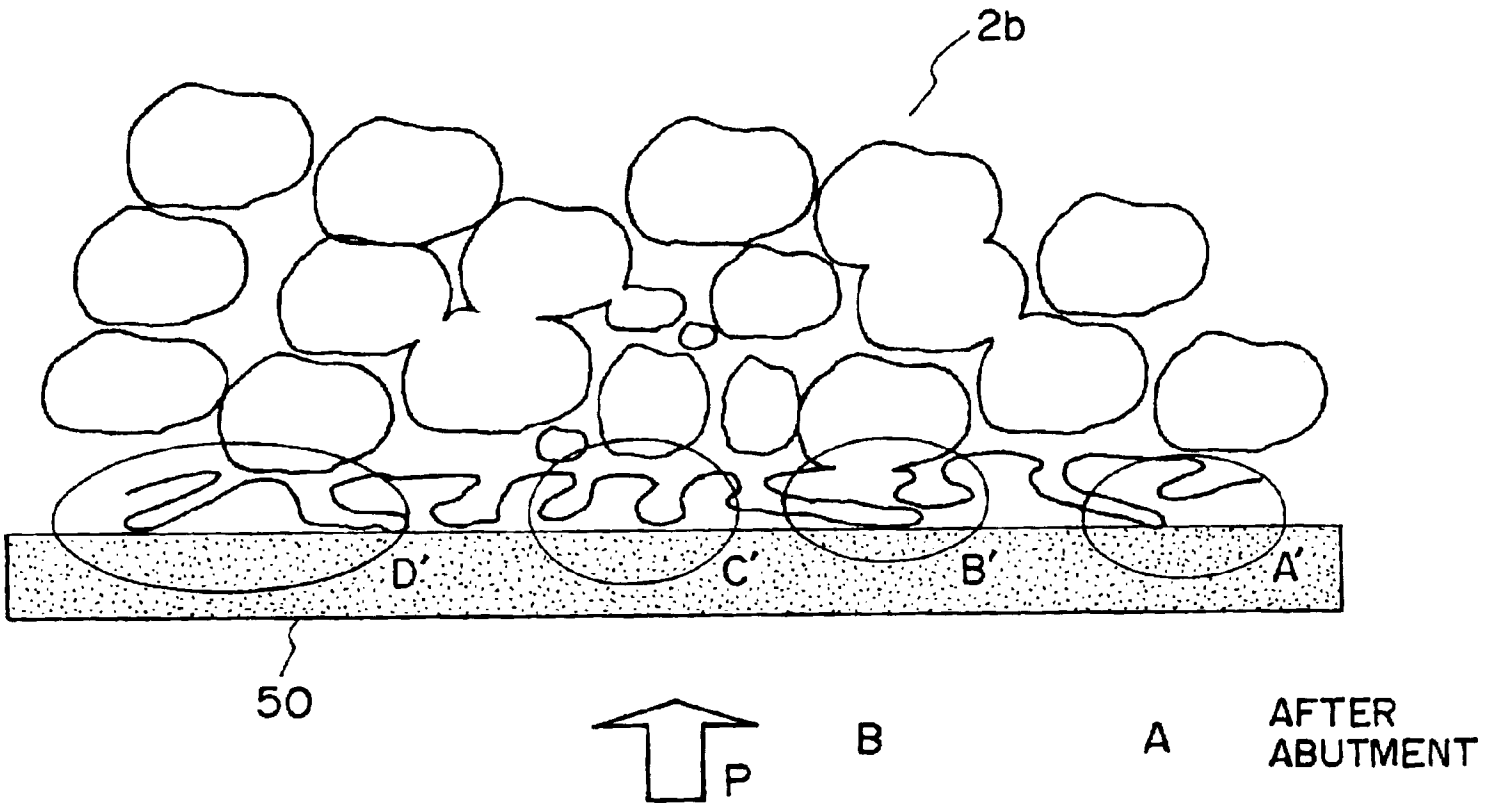
FIG. 8 is a schematic sectional view of the sponge roller surface in a state that a glass plate abuts on the sponge roller surface.

FIG. 8 is a schematic illustration of a cross-section of the sponge roller 2 in such a state that the glass plate 50 abuts on the sponge roller surface.

Referring to FIG. 8, opening portions A' B', C' and D' after the abutment correspond to the opening portions A, B, C and D before the abutment shown in FIG. 7, respectively.

At the opening portion A', the cell wall portions are bent toward the inside of the cell portions, so that the contact area with the abutting surface (the observation direction P) is increased. At the opening portion B', the gap observed before the abutment (FIG. 7) is not observed. This is because, a described above, the cell wall portions at the opening portion are bent toward the inside of the cell portions to fill the gap and intimately contact the glass plate surface. Further, at the opening portion C', relatively short cell wall portions are deformed under pressure to contact intimately the glass plate surface. At the opening portion D', the cell wall portions are bent toward the outside of the cell portions to increase the contact area with the abutting surface.

In other words, through the above observation, it is possible to confirm that the sponge roller 2 used in this embodiment exhibits a close contact performance against the abutting surface.

Figure 9:
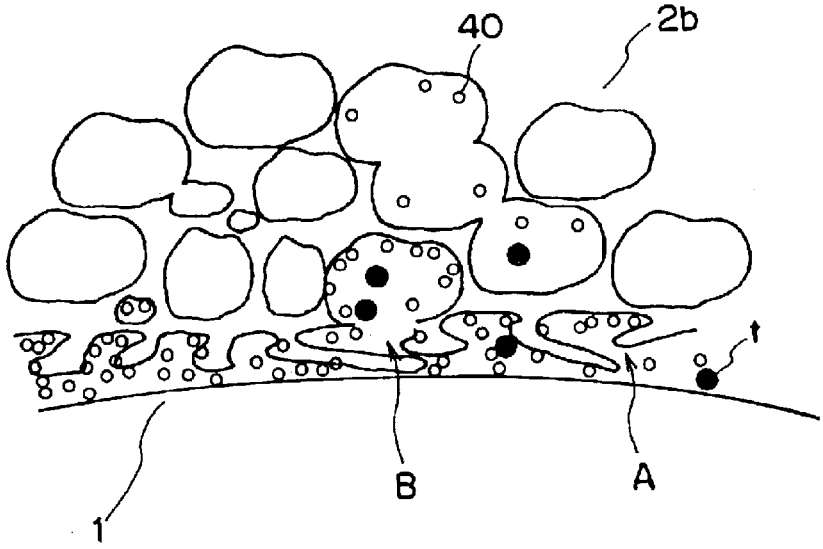
FIG. 9 is an enlarged schematic sectional view of the sponge roller surface at an abutting portion when the sponge roller abuts against the photosensitive drum.

FIG. 9 is an enlarged schematic illustration of a cross-section in the vicinity of the abutting region where the sponge roller 2 abuts against the photosensitive drum 1.

Referring to FIG. 9, the sponge roller 2 has the communicating characteristic, so that the sponge roller surface has a gap as shown in the cell B. The electroconductive particles 40 uniformly attach to the surface of the sponge roller 2 and enter the inner cell portion of the cell with a gap as in the cell B. As a result, a particle-carrying performance of the sponge roller 2 is improved to enhance the charging performance. In addition, the sponge roller 2 has no excessive gap as in a roller having an open cell structure wherein cells are connected to each other, so that it is possible to suppress an occurrence of a fibrous paper dust (powder) accumulation and a lump of the transfer residual toner resulting from the paper dust accumulation. Further, the cell wall portions are sufficiently thin, so that the gap is filled with the cell wall by pressing the sponge roller 2 under the load (total pressure) of 800 g to cause the abutment of the sponge roller 2 against the photosensitive drum 1, thus resulting in an enhanced surface evenness of the sponge roller 2. Consequently, the gap is stopped up while retaining the particle-carrying performance, whereby it becomes possible to provide a uniform contact surface against the photosensitive drum 1, thus further effectively improving the uniform charging performance.

As described above, the charging member may preferably have the gap ratio Ra (gap area per area at cell surface) of not less than 5% and not more than 50% at its surface. Accordingly, in the present invention, the elastic foam member is not constituted by a complete closed-cell structure but has a cell structure having a connection between adjacent cells (cell-communicating performance). Based on this cell-communicating performance, the sponge roller surface has the gap ratio Rs of not less than 5% and not more than 50%. By setting the gap ratio Rs within the range of 5–50%, it is possible to suppress an accumulation of fibrous paper dust and an occurrence of a lump of the transfer residual toner resulting from the paper dust accumulation, as observed in the open-cell roller, while appropriately holding the amount of the electroconductive particles required for direct injection charging.

Miscellaneousness

1) In the above embodiments, the image forming apparatus is used as the laser beam printer but may be used as another image forming apparatus, such as an electrophotographic copying machine, a facsimile apparatus, a word processor, etc., or an image display apparatus, such a an electronic copyboard. Further, the image forming apparatus of the present invention is not limited to that of the cleanerless type.

2) The exposure means for forming the electrostatic latent image is not restricted to the laser beam scanning exposure means for forming a latent image in a digital manner as in the above embodiments but may be other means, such as an ordinary analog image exposure means and light-emitting devices including LED. It is possible to apply any means capable of forming an electrostatic latent image corresponding to image data, such as a combination of the light-emitting device, such a fluorescent lamp with a liquid crystal shutter.

The image bearing member as the member to be charged is an electrostatic recording dielectric body in the case of an electrostatic recording apparatus. In this case, the surface of the dielectric body is charged uniformly to a predetermined polarity and a predetermined potential and then is charge-removed selectively by charge-removing means, such as a charge removing needle array or an electron gun, thereby to form an objective electrostatic latent image by writing.

3) The image bearing member is not limited to the drum-type but may be an endless belt-type, a belt-type having an end, a sheet-type, etc.

4) The contact charging member is not limited to the roller-type but may be an endless belt-type or a belt-type having an end.

5) The developing apparatus used in the above-mentioned embodiments is of a reversal development-type but is not limited thereto. A normal development-type developing apparatus is also applicable.

Generally, the developing method of the electrostatic latent image may be roughly classified into four types including; a monocomponent non-contact developing method wherein a toner coated on a developer-carrying member such as a sleeve with a blade, etc., for a non-magnetic toner or coated on a developer-carrying member by the action of magnetic force for a magnetic toner is carried and applied onto the image bearing member in a non-contact state to develop an electrostatic latent image; a mono-component contact developing method wherein the toner coated on the developer-carrying member in the above-mentioned manner is applied onto the image bearing member in a contact state to develop the electrostatic latent image; a two-component contact developing method wherein a two-component developer prepared by mixing toner particles with a magnetic carrier is carried and applied onto the image bearing member in contact state to develop the electrostatic latent image; and a two-component non-contact developing method wherein the two-component developer is applied onto the image-bearing member in a non-contact state to develop the electrostatic latent image. To the present invention, there four-types of the developing methods are applicable.

6) The transfer means is not restricted to the transfer roller but may be modified into transfer means using a belt, corona discharge, etc. Further, it is also possible to employ an intermediate transfer member (a member to be temporarily transferred) such as a transfer drum or a transfer belt, for use in an image forming apparatus for forming multi-color or full-color images by multiple-transfer operation, in addition to a monochromatic image.

7) The charging member or the charging apparatus used in the present invention is not restricted to charging means for charging the image bearing member (electrophotographic photosensitive member, electrostatic recording dielectric body, etc.) of the image forming apparatus, but may be widely applicable effectively as charge-treating means (including a charge removal means) for the member to be charged.

What is claimed is:

1. A charging member for charging a member to be charged in a state that said charging member forms a nip with the member to be charged and electroconductive particles are present at the nip, said charging member comprising:

an elastic foam member provided at a surface of said charging member, said elastic foam member including cell portions and cell wall portions defining the cell portions, wherein the cell wall portions have a thickness proportion to the cell portions of not less than 2% and not more than 40%.

2. A member according to claim 1, wherein gaps connecting the cell portions viewed from a surface of said charging member after the nip between said charging member and the member to be charged is formed is decreased when compared to the gaps connecting the cell portions before the nip is formed.

3. A member according to claim 1, wherein gaps connecting the cell portions have areas which are not less than 5% and not more than 50%, per a projected area of each cell portion.

4. A member according to claim 1, wherein said charging member has a microhardness of 12–16 degrees.

5. A member according to claim 1, wherein said electroconductive particles have a volume resistivity of not more than $10^{12}$ ohm.cm.

6. A member according to claim 1, wherein said electroconductive particles have a particle size of not more than 3 $\mu$m.

7. A member according to claim 1, which moves at a peripheral speed different from a peripheral speed of the member to be charged in the nip.

8. A member according to claim 1, which is in the form of a roller and rotates counterdirectionally to a moving direction of the member to be charged in the nip.

9. A member according to claim 1, further including an electrode, to be supplied with a voltage, disposed inside said elastic foam member.

10. A charging apparatus, comprising:

a charging member for charging a member to be charged in a state that said charging member forms a nip with the member to be charged and electroconductive particles are present at the nip, wherein said charging member comprises an elastic foam member provided at a surface of said charging member, said elastic foam member including cell portions and cell wall portions defining the cell portions, wherein the cell wall portions have a thickness proportion to the cell portions of not less than 2% and not more than 40%.

11. An apparatus according to claim 10, wherein gaps connecting the cell portions viewed from a surface of said charging member after the nip between said charging member and the member to be charged is formed is decreased when compared to the gaps connecting the cell portions before the nip is formed.

12. An apparatus according to claim 10, wherein gaps connecting the cell portions have areas which are not less than 5% and not more than 50%, per a projected area of each cell portion.

13. An apparatus according to claim 10, wherein said charging member has a microhardness of 12–16 degrees.

14. An apparatus according to claim 10, wherein said electroconductive particles have a volume resistivity of not more than $10^{12}$ ohm.cm.

15. An apparatus according to claim 10, wherein said electroconductive particles have a particle size of not more than 3 $\mu$m.

16. An apparatus according to claim 10, wherein said charging member moves at a peripheral speed different from a peripheral speed of the member to be charged in the nip.

17. An apparatus according to claim 10, wherein said charging member is in the form of a roller and rotates counterdirectionally to a moving direction of the member to be charged in the nip.

18. An apparatus according to claim 10, wherein said charging member further includes an electrode, to be supplied with a voltage, disposed inside said elastic foam member.

19. An apparatus according to claim 10, wherein the member to be charged is capable of bearing an image, and the member to be charged and the charging apparatus are provided in a process cartridge detachably mountable to a main body of an image forming apparatus.

20. An image forming apparatus, comprising:

a member to be charged which is capable of bearing an image; and a charging member for charging the member to be charged in a state that said charging member forms a nip with the member to be charged and electroconductive particles are present at the nip, wherein said charging member comprises an elastic foam member provided at a surface of said charging member, said elastic foam member including cell portions and cell wall portions defining the cell portions, wherein the cell wall portions have a thickness proportion to the cell portions of not less than 2% and not more than 40%.

21. An apparatus according to claim 20, wherein gaps connecting the cell portions viewed from the surface of said charging member after the nip between said charging member and the member to be charged is formed is decreased when compared to the gaps connecting the cell portions before the nip is formed.

22. An apparatus according to claim 20, wherein gaps connecting the cell portions have areas which are not less than 5% and not more than 50%, per a projected area of each cell portion.

23. An apparatus according to claim 20, wherein said charging member has a microhardness of 12–16 degrees.

24. An apparatus according to claim 20, wherein said electroconductive particles have a volume resistivity of not more than $10^{12}$ ohm.cm.

25. An apparatus according to claim 20, wherein said electroconductive particles have a particle size of not more than 3 $\mu$m.

26. An apparatus according to claim 20, wherein said charging member moves at a peripheral speed different from a peripheral speed of the member to be charged in the nip.

27. An apparatus according to claim 20, wherein said charging member is in the form of a roller and rotates counterdirectionally to a moving direction of the member to be charged in the nip.

28. An apparatus according to claim 20, wherein said charging member further includes an electrode, to be supplied with a voltage, disposed inside said elastic foam member.

29. An apparatus according to claim 20, wherein the member to be charged and the charging apparatus are provided in a process cartridge detachably mountable to a main body of an image forming apparatus.

30. An apparatus according to claim 20, which further comprises developing means for developing the image borne on the member to be charged with a developer, said developing means being capable of effecting a recovery operation for recovering a residual developer remaining on the member to be charged together with a developing operation.

31. An apparatus according to claim 30, wherein the developer contains the electroconductive particles and the developing means is capable of supplying the electroconductive particles to the member to be charged, which is capable of carrying the electroconductive particles to said charging member.

32. An apparatus according to claim 31, wherein the developer further contains a magnetic toner.

* * * * *

UNITED STATES PATENT AND TRADEMARK OFFICE

CERTIFICATE OF CORRECTION

PATENT NO. : 6,882,814 B2
DATED : April 19, 2005
INVENTOR(S) : Hiroshi Satoh et al.

It is certified that error appears in the above-identified patent and that said Letters Patent is hereby corrected as shown below:

Title page,
Item [57], ABSTRACT,
Lines 3 and 6, “said” should read -- the --.

Column 2,
Line 46, “be” should read -- been --.

Column 3,
Line 11, “placing” should read -- place --; and
Line 21, “b” should read -- be --.

Column 7,
Line 18, “visualized” should read -- visualize --; and
Line 54, “is” should be deleted.

Column 12,
Line 26, “ate” should read -- are --; and
Line 40, “a” should read -- as --.

Column 13,
Line 33, “a” should read -- as --; and
Line 45, “such” should read -- such as --.

Column 14,
Line 18, “there” should be deleted.

Signed and Sealed this

Twenty-seventh Day of September, 2005

JON W. DUDAS
*Director of the United States Patent and Trademark Office*